US005941352A

United States Patent [19]

Lee

[11] Patent Number: 5,941,352

[45] Date of Patent: Aug. 24, 1999

[54] COMBINATION OF TRAVEL BAG AND FOLDING TABLE

[76] Inventor: Chun-Ping Lee, Rm. 301, No. 41, Sec. 5, Min-Sheng E. Rd., Taipei, Taiwan

[21] Appl. No.: 09/040,346

[22] Filed: Mar. 18, 1998

[51] Int. Cl.[6] ..... A45F 3/00

[52] U.S. Cl. ..... 190/11; 190/18 A; 280/37

[58] Field of Search ..... 190/11, 12 A; 280/37; 108/15, 62

[56] References Cited

U.S. PATENT DOCUMENTS

| | | | |
|---|---|---|---|
| D. 142,262 | 8/1945 | Paden | 190/11 |
| 2,604,959 | 7/1952 | Arbib | 190/11 |
| 3,557,916 | 1/1971 | Stowell | 190/11 |
| 4,595,086 | 6/1986 | Simpson | 190/11 |
| 5,437,367 | 8/1995 | Martin | 190/11 |

*Primary Examiner*—Gary E. Elkins
*Assistant Examiner*—Tri M. Mai
*Attorney, Agent, or Firm*—Rosenberg, Klein & Bilker

[57] ABSTRACT

A combination of travel bag and folding table which includes a travel bag, a table board having a first end pivoted to a top side of the travel bag and a free end, a retractable stand having one end pivoted to the free end of the table board and an opposite end mounted with a foot, hinge means coupled between the travel bag and the table board for permitting the table board to be turned about an axis within 90°, first lock means for securing the table board, the retractable stand and the travel bag together when the table board and the retractable stand are collapsed, and second lock means for stopping the wheels of travel bag from moving.

2 Claims, 9 Drawing Sheets

COMBINATION OF TRAVEL BAG AND FOLDING TABLE

BACKGROUND OF THE INVENTION

The present invention relates to travel bags, and more particularly to a combination of travel bag and folding table which comprises a travel bag, a folding table pivoted to the travel bag, and a retractable stand pivoted to the folding table and used for supporting the folding table on the ground when the folding table is extended out of the travel bag.

U.S. patent application Ser. No. 08/925,748, which was an invention of the present inventor, discloses a travel bag and folding table arrangement which combines a travel bag and a folding table into a compact unit. This structure of travel bag and folding table arrangement is functional. However, because the wheels of the travel bag are not locked when the table board is extended out and supported on the ground by the retractable stand, the whole assembly cannot be stably supported on the ground.

SUMMARY OF THE INVENTION

The present invention has been accomplished to provide a combination of travel bag and folding table which eliminates the aforesaid problem. According to one aspect of the present invention, the combination of travel bag and folding table comprises a travel bag having a top side, a bottom side, and a plurality of wheel holders respectively mounted on the bottom side, the wheel holders each holding a wheel; a table board having a fixed end pivoted to the top side of the travel bag and a free end; hinge means coupled between the top side of the travel bag and the fixed end of the table board, the hinge means comprising a first leaf fixedly fastened to the travel bag, a second leaf integral with the smoothly arched portion of the fixed end of the table board, the first leaf having a plurality of longitudinally aligned barrels and a longitudinal locating groove adjacent to the barrels on the first leaf, the second leaf having a plurality of longitudinally aligned barrels, and a pivot pin mounted in the barrels at the first leaf and the barrels at the second leaf to secure the first leaf and the second leaf together, for permitting the table board to be turned about the pivot pin relative to the travel bag within a limited angle, the first leaf having a longitudinal locating groove, the second leaf having a flange at one side inserted into the longitudinal locating groove on the first leaf to limit the turning angle of the table board about the pivot pin; a retractable stand pivoted to the free end of the table board, the retractable stand comprising two coupling holder frames bilaterally pivoted to the fixed end of the table board at a bottom side by a respective pivot, the coupling holder frames each having a longitudinal sliding slot, two sleeves respectively pivoted to the coupling holder frames by a respective pivot, the sleeves each having a longitudinal sliding slot corresponding to the longitudinal sliding slots on the coupling holder frames, a control block connected between said sleeves at one end remote from the coupling holder frames, two inner tubes slidably inserted into said sleeves, a foot connected between said inner tubes at one end remote from said sleeves, two side plates respectively coupled to said foot plate at two opposite sides and turned between a first position where the side plates are longitudinally aligned with said foot and a second position where the side plates are attached to said foot plate, two folding braces, the folding brace each having one end pivoted to one coupling holder frame and an opposite end pivoted to the table board, two push rods respectively coupled to the sleeves and moved along longitudinal sliding slots on the sleeves and said coupling holder frames, the push rods each having a hooked end extended out of the longitudinal sliding slots on the coupling holder frames and the sleeves and retained in contact with the folding braces, spring means respectively mounted in the coupling holder frames and imparting an outward pressure to the push rods respectively, the push rods being forced inwards to collapse the folding braces when the inner tubes are received in the sleeves, and two torsional springs respectively mounted on the pivots at the coupling holder frames, the torsional springs each having one end stopped at the table board and an opposite end connected to a lug at one coupling holder frame, the control block comprising two locating members, a spring connected between the locating members, the locating members each having a pin at an outer side respectively forced by the spring between the locating members into engagement with respective locating holes at the inner tubes to stop the inner tubes from axial movement in the sleeves, and a control knob coupled to the locating members, the locating members being pulled inwards to disengage the respective pins from the locating holes on the inner tubes when the control knob is depressed, for permitting the inner tubes to be moved in and out of the sleeves; first lock means for securing the table board, the retractable stand and the travel bag together when the table board is collapsed and attached to the travel bag, the first lock means comprising a knob mounted on the table board, a box at the table board remote from the knob, a link having a top end coupled to the knob of the first lock means and a bottom end inserted into the box, a movable hook coupled to the bottom end of the link inside the box, spring means mounted inside the box and imparting an upward pressure to the movable hook, and a fixed hook fixedly mounted on the travel bag at one side, the fixed hook being inserted through a hole on the box into engagement with the movable hook to secure the table board in place when the table board is closed on the travel bag, the movable hook being disengaged from the fixed hook when the knob of the first lock means is depressed, the link having a hook, the hook of the link being forced into engagement with the foot of the retractable stand when the retractable stand is collapsed and attached to the table board; and second lock means for stopping the wheels of travel bag from moving, the second lock means comprises a latch mounted in the travel bag near the wheel of one wheel holder of the travel bag, spring means which imparts an outward pressure to the latch, causing the latch to be forced into engagement with one of a series of locating holes on the wheel of the adjacent wheel holder, and a knob mounted on the travel bag and controlled to disengage the latch from the locating holes on the corresponding wheel.

DETAILED DESCRIPTION OF THE PREFERRED EMBODIMENT

Figure 11:
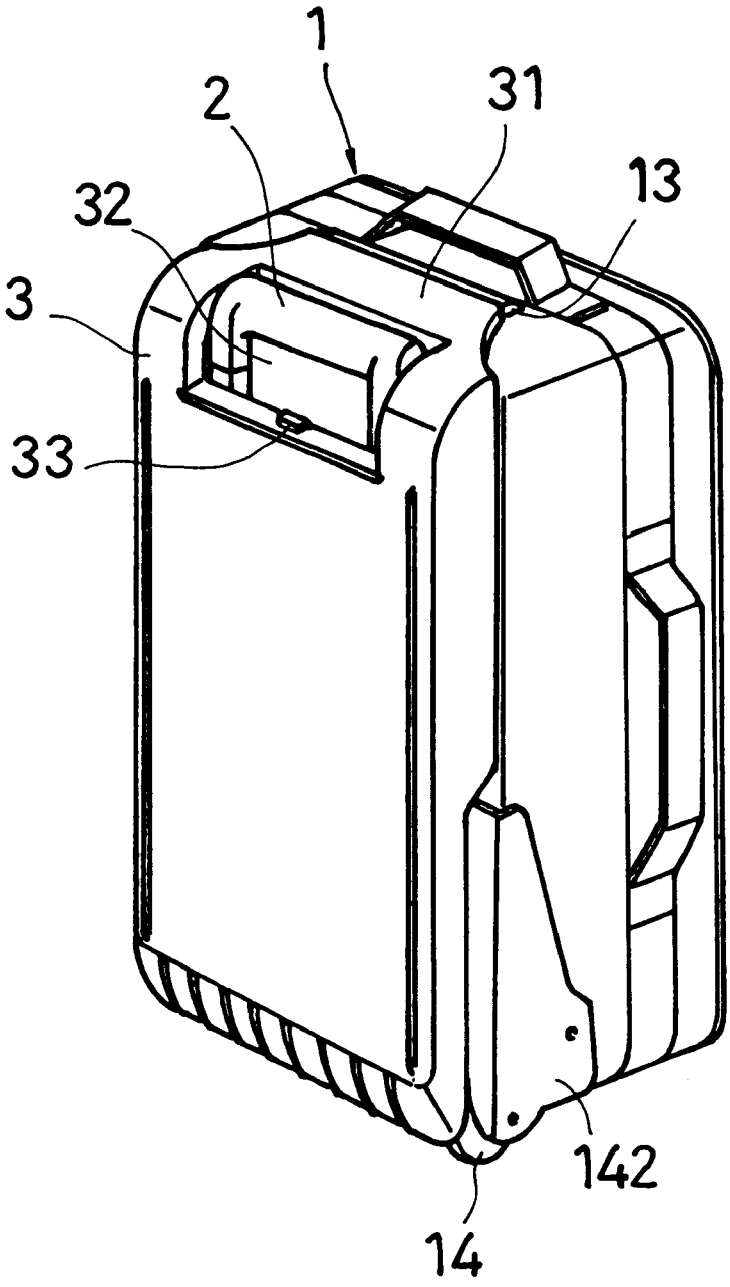
FIG. 11 is another perspective view of the present invention.

Referring to Figures from 1 to 5, a rectangular table board 3 is coupled to one side of a travel bag 1 by for example a hinge, and a retractable stand 4 fastened to one side of the table board 3 remote from the travel bag 1. The aforesaid hinge comprises a first leaf 13 fixedly fastened to the travel bag 1, a second leaf 31 integral with a smoothly arched portion 32 at one short side of the table board 3, and a pivot pin 313 mounted in barrels 132 at the first leaf 31 and barrels 311 at the second leaf 31 to secure the leaves 13;31 together, for permitting the table board 3 to be turned about the pivot pin 313 relative to the travel bag 1. The first leaf 13 has a longitudinal groove 131. The second leaf 31 has a flange 312 at one side inserted into the longitudinal groove 131 to limit the turning of the table board 3 within about 90°. Therefore, the table board 3 can be turned within 90° relative to the travel bag 1 and set between the collapsed position closely attached to the travel bag 1 (see FIG. 11) and the operative position perpendicular to the travel bag 1 (see FIG. 1). When the table board 3 is set in the operative position, the retractable stand 4 is extended out to support the table board 3 on the ground in a horizontal position.

Referring to FIGS. 1, 5, 6 and 7, the retractable stand 4 comprises two coupling holder frames 45 respectively pivoted to lugs 36 on the table board 3 by a respective pivot 454, two sleeves 42 respectively pivoted to the coupling holder frames 45 by a respective pivot 455, a control block 41 connected between the sleeves 42 at one end remote from the coupling holder frames 45, two inner tubes 43 slidably mounted in the sleeves 42, a foot 44 connected between the inner tubes 43 at one end remote from the sleeves 42, and two folding braces 451, each folding brace 451 having one end pivoted to one coupling holder frame 45 and an opposite end pivoted to a rib 35 on the table board 3. When the table board 3 is turned outwards from the travel bag 1 and supported on the ground by the retractable stand 4, the folding braces 451 are extended out to support the coupling holder frames 45 in the extended position. Two push rods 432 are respectively coupled to the sleeves 42 and moved along longitudinal sliding slots 421 on the sleeves 42 and the coupling holder frames 45, each push rod 432 having a hooked end 4321 extended out of the respective coupling holder frame 45 and retained in contact with one folding brace 451. A spring 433 is connected between the pivot 455 in one coupling holder frame 45 and the push rod 432 in one sleeve 42. The spring 433 imparts an outward pressure to the respective push rod 432. When the inner tubes 43 are received in the sleeves 42, the push rods 432 are respectively forced inwards to compress the springs 433, and simultaneously to collapse the folding braces 451. Two torsional springs 453 are respectively mounted on the pivots 454, each torsional spring 453 having one end stopped at the bottom of the table board 3 and an opposite end connected to a lug 452 at one coupling holder frame 45. When the table board 3 is extended out, the retractable stand 4 is automatically forced outwards by the torsional springs 453.

Figure 1:
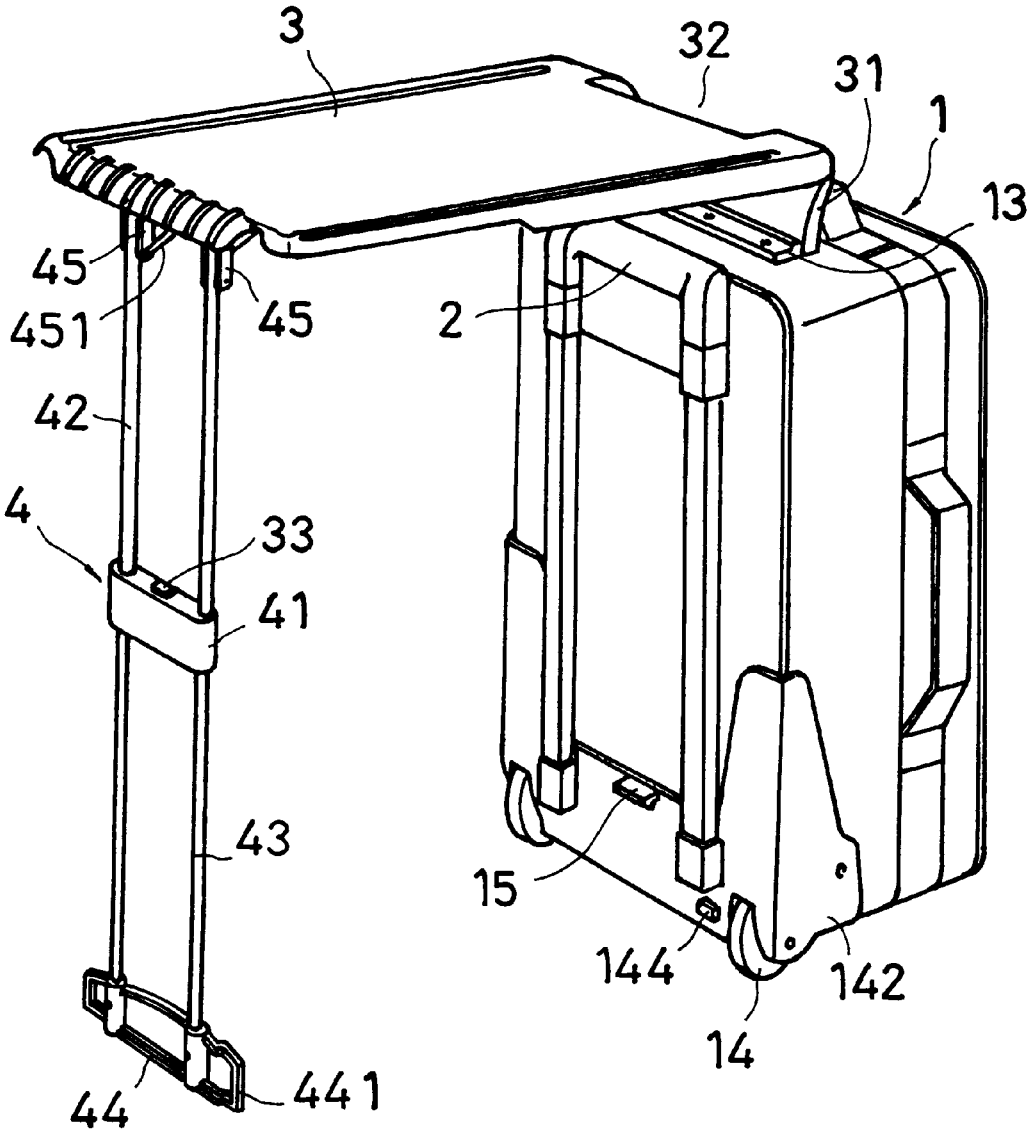
FIG. 1 is a perspective view of the present invention, showing the table board and the retractable stand set in the operative condition.
Figure 2A:
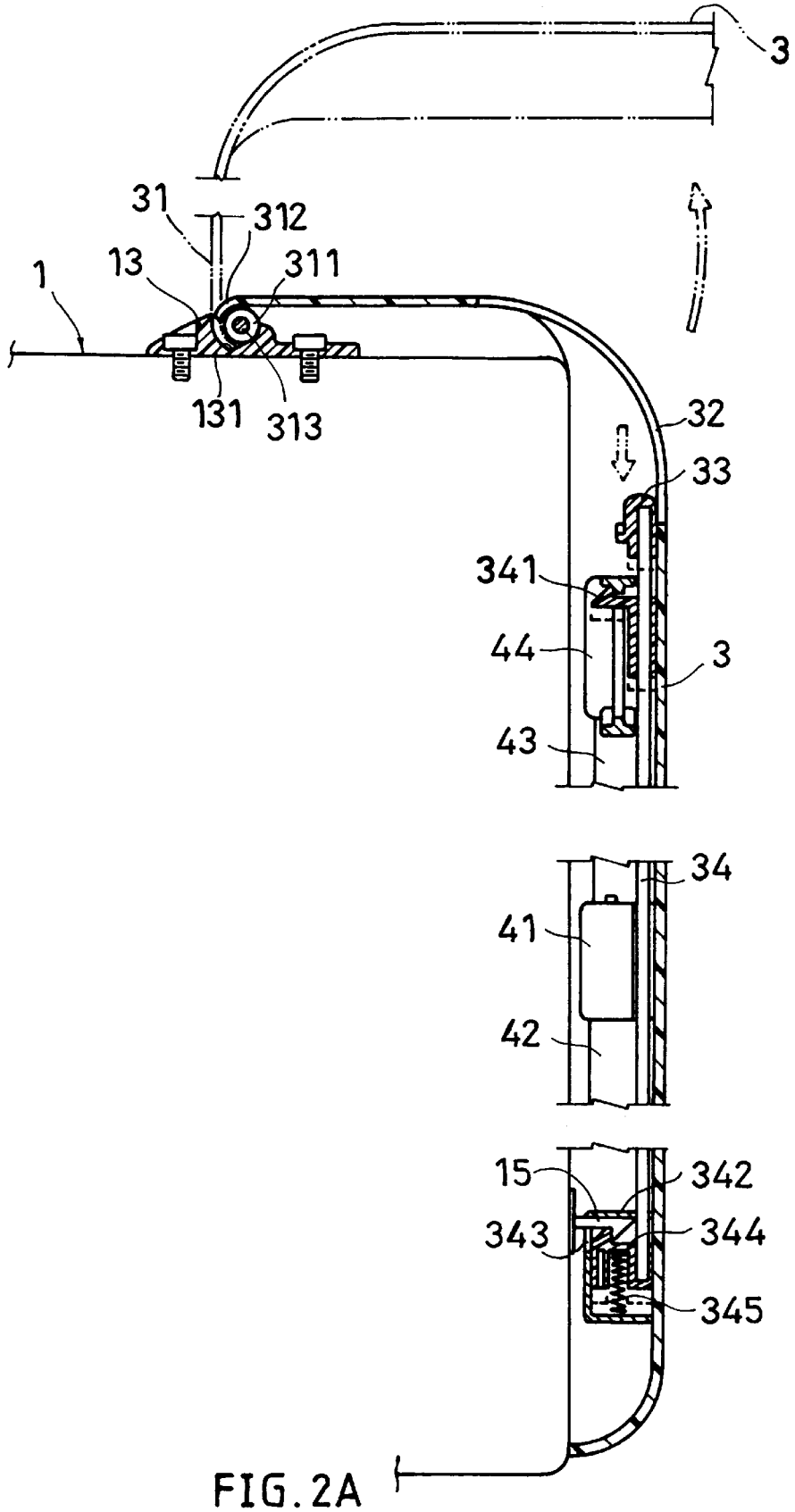
FIG. 2A is a sectional view of a part of the present invention, showing the inside structure of the table board.
Figure 2B:
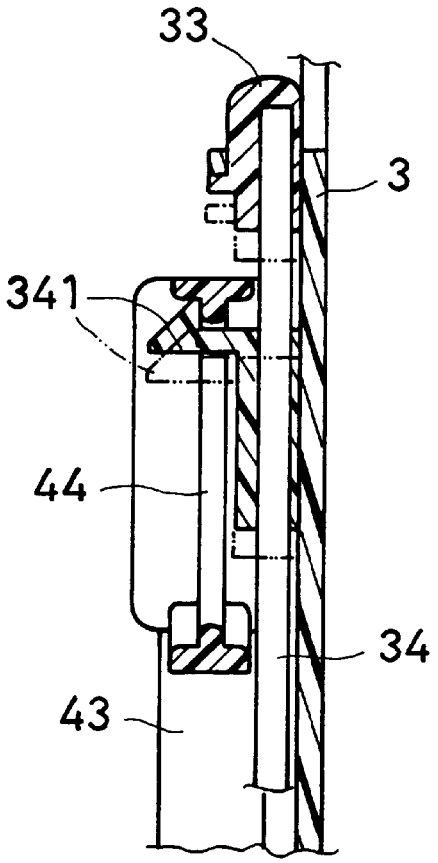
FIG. 2B is an enlarged view of the upper part of the table board shown in FIG. 2A.
Figure 2C:
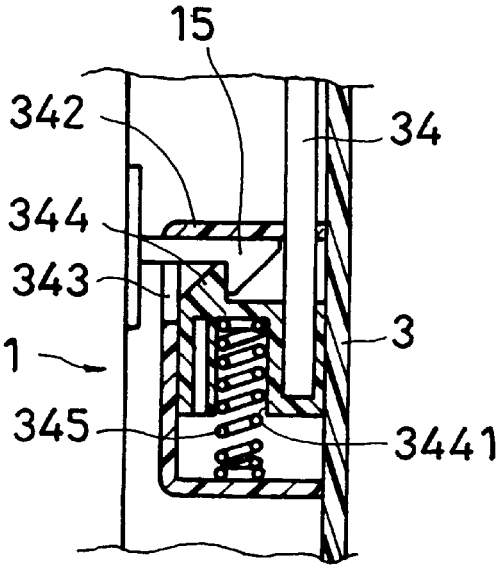
FIG. 2C is an enlarged view of the lower part of the table board shown in FIG. 2A.
Figure 3:
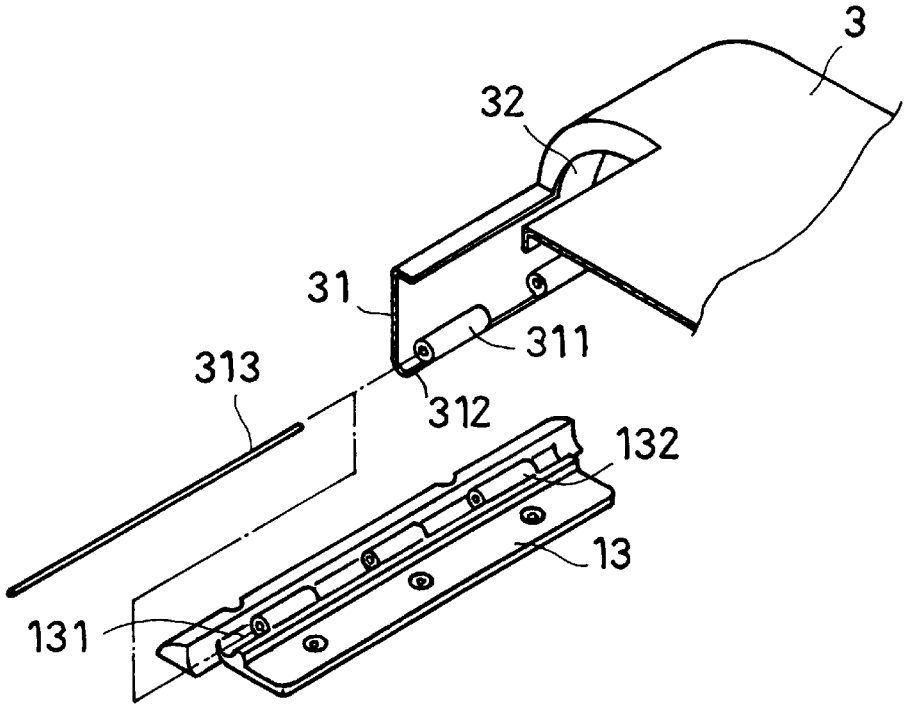
FIG. 3 is an exploded view of the hinge according to the present invention.
Figure 4:
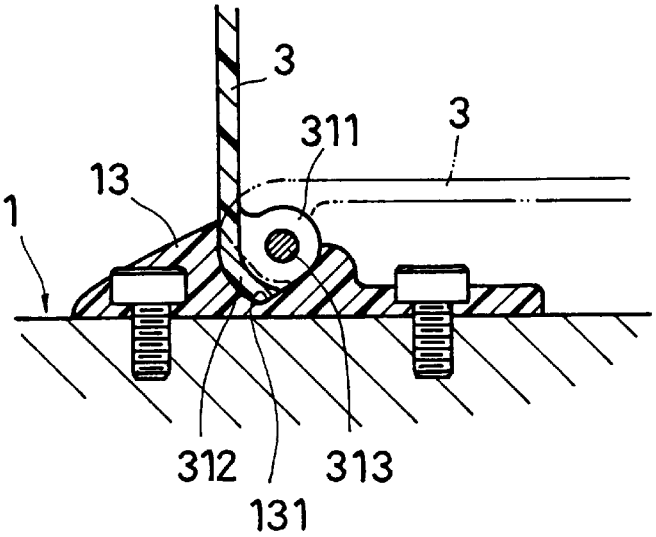
FIG. 4 is a sectional view of a part of the present invention, showing the hinge installed.
Figure 6:
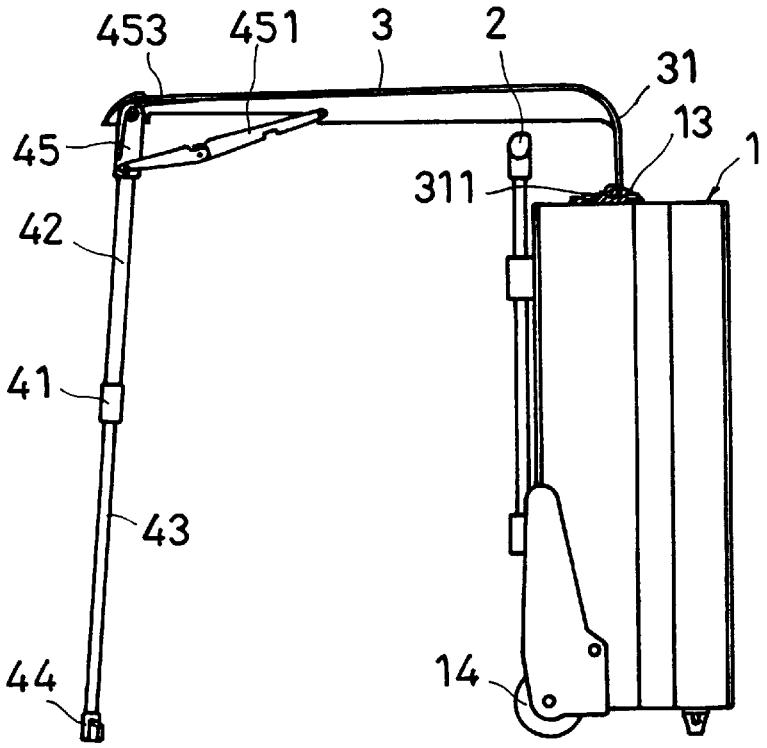
FIG. 6 is a side view of the present invention, showing retractable stand extended out, the table board supported on the retractable stand.
Figure 5:
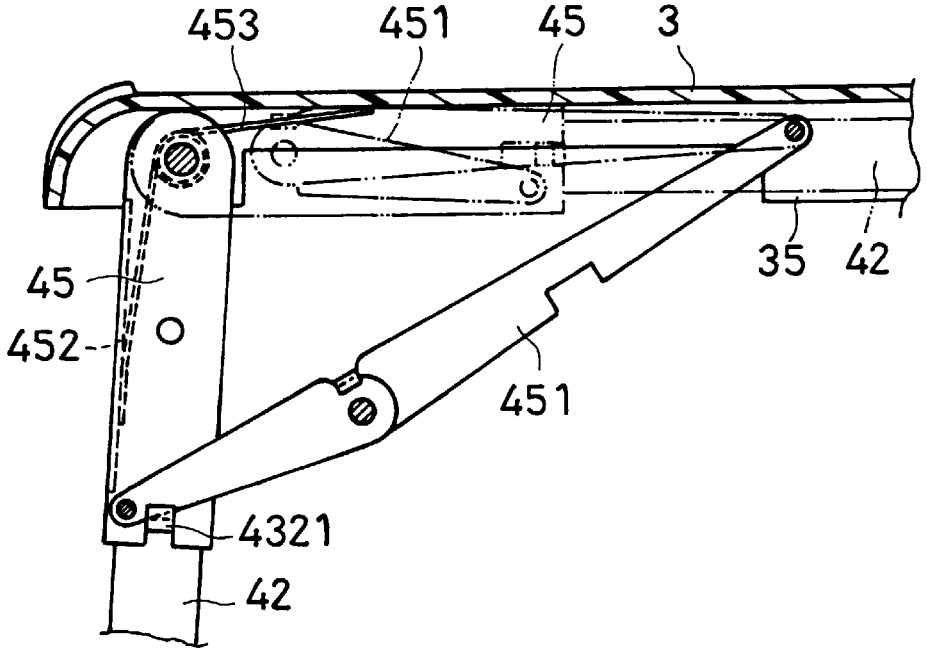
FIG. 5 is a sectional view of a part of the present invention, showing the connection between the retractable stand and the table board.
Figure 7:
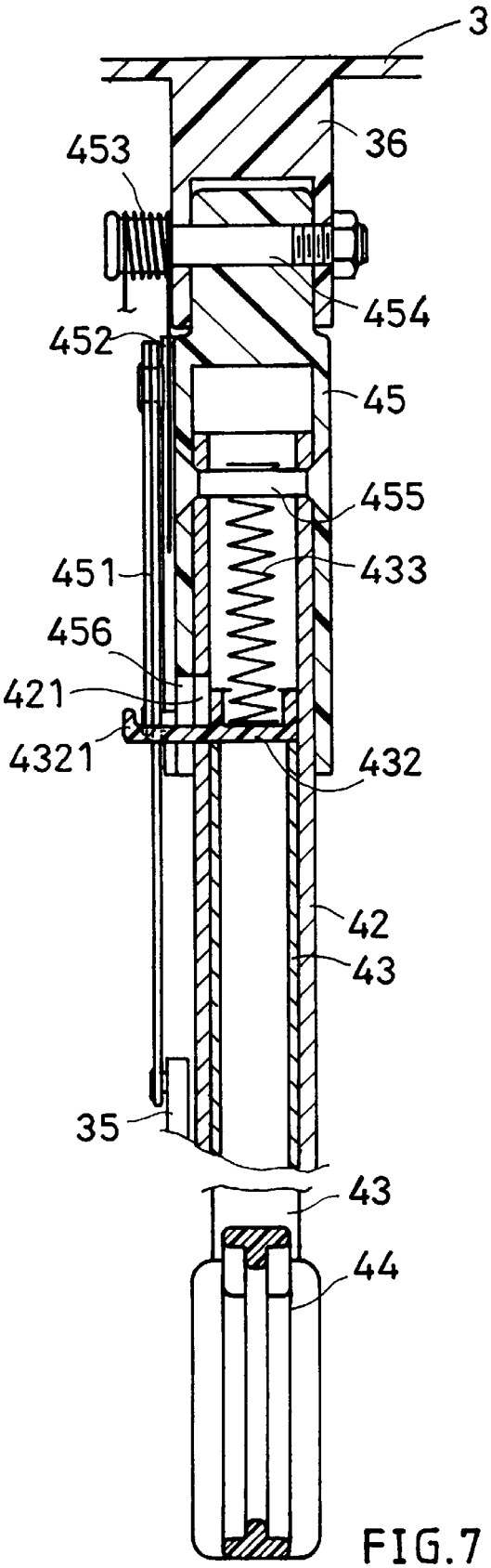
FIG. 7 is a cross sectional view in an enlarged scale of the control block of the retractable stand according to the present invention.
Figure 8:
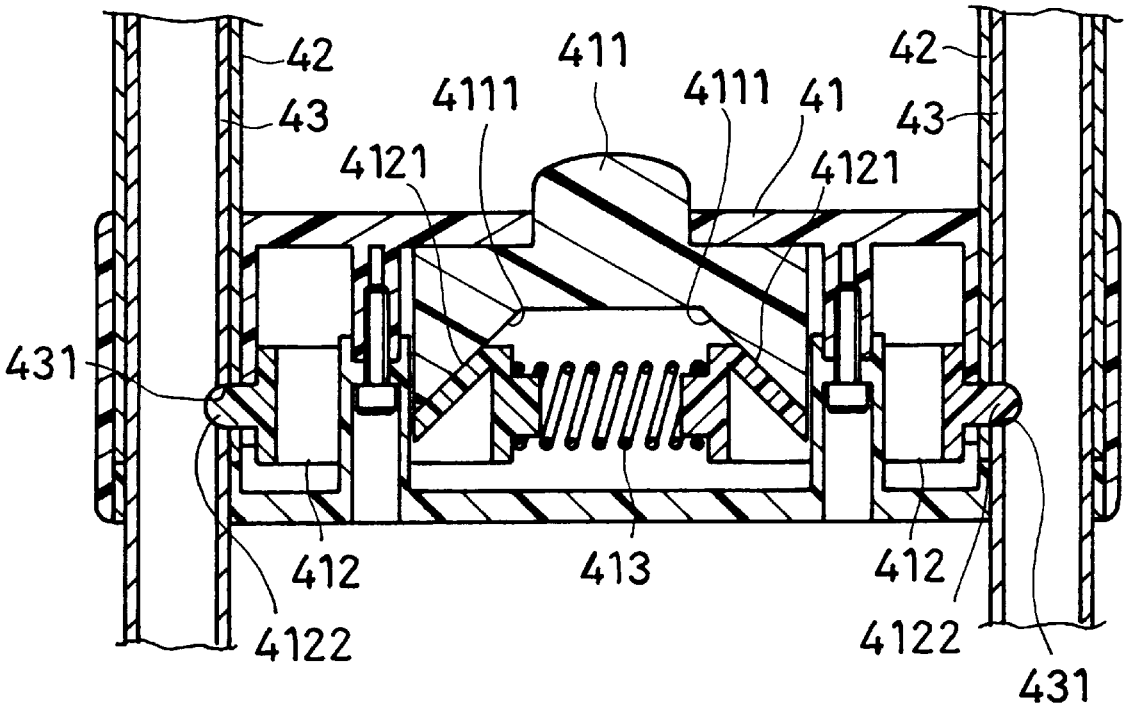
FIG. 8 is a sectional view in an enlarged scale of a part of the present invention, showing the table board collapsed, and the lock locked.

Referring to FIGS. 1, 6 and 8, the control block 41 comprises a spring 413, two locating members 412 bilaterally supported on the spring 413, each locating member 412 having a pin 4122 at an outer side respectively forced by the spring 44 into engagement with respective locating holes 431 at the inner tubes 43. The locating members 412 each have a respective bevel face 4121 at an inner side. A control knob 411 is mounted in a hole (not shown) at the top side of the control block 41, having two bevel faces 4111 respectively disposed in contact with the bevel faces 4121 of the locating members 412. When the control knob 411 is depressed, the bevel faces 4111 of the control knob 411 are forced against the bevel faces 4121 of the locating members 412, thereby causing the locating members 412 to be pulled inwards and disengaged from the locating holes 431 on the inner tubes 43, for permitting the inner tubes 43 to be moved into the sleeves 42.

Figure 9:
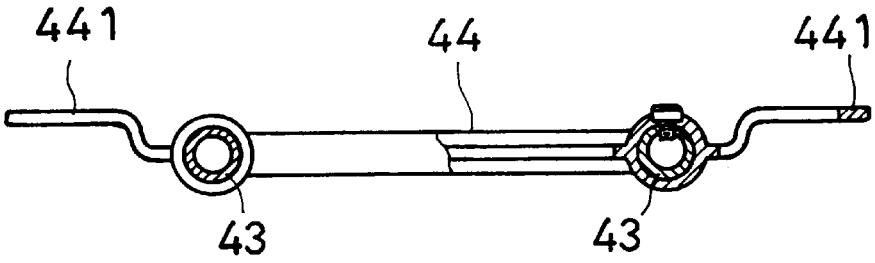
FIG. 9 is an elevational view of the present invention, showing the table board collapsed and locked.

Referring to FIG. 9, two side plates 441 are respectively pivoted to two opposite sides of the foot 44. The side plates 441 can be turned outwards into longitudinal alignment with the foot 44 for supporting the retractable stand 4 on the ground stably. When not in use, the side plates 441 are turned inwards and closely attached to the foot 44.

Referring to FIGS. 2A, 2B, 2C and 11, a knob 33 is mounted on the table board 3 in the space 32 at one end of a link 34. The link 34 has an opposite end inserted into a box 342 at the bottom side of the table board 3. The box 342 has a hole 343. A movable hook 344 is coupled to one end of the link 34 inside the box 342 The movable hook 344 has a bottom hole 3441. A spring 345 is mounted in the bottom hole 3441 on the hook 344 and supported on the bottom wall of the box 342. The spring 345 imparts an upward pressure to the hook 344 and the link 34. The travel bag 1 has a hook 15 at one side near the bottom. When the table board 3 is closed on the travel bag 1, the hook 15 is inserted through the hole 343 into the box 342 into engagement with the movable hook 344. The link 34 has a hook 341 near the knob 33. When the retractable stand 4 is collapsed, the foot 44 is forced into engagement with the hook 341. When extending out the table board 3, the knob 33 is depressed to lower the link 34. When the link 34 is lowered, the hooks 341;344 are simultaneously lowered and respectively disengaged from the hook 15 on the travel bag 1 and the foot 44 of the retractable stand 4, and the retractable stand 4 is forced outwards from the travel bag 1 by the torsional springs 453. After the control knob 411 has been depressed, the inner tubes 43 can then be pulled out of the sleeves 42.

Figure 10:
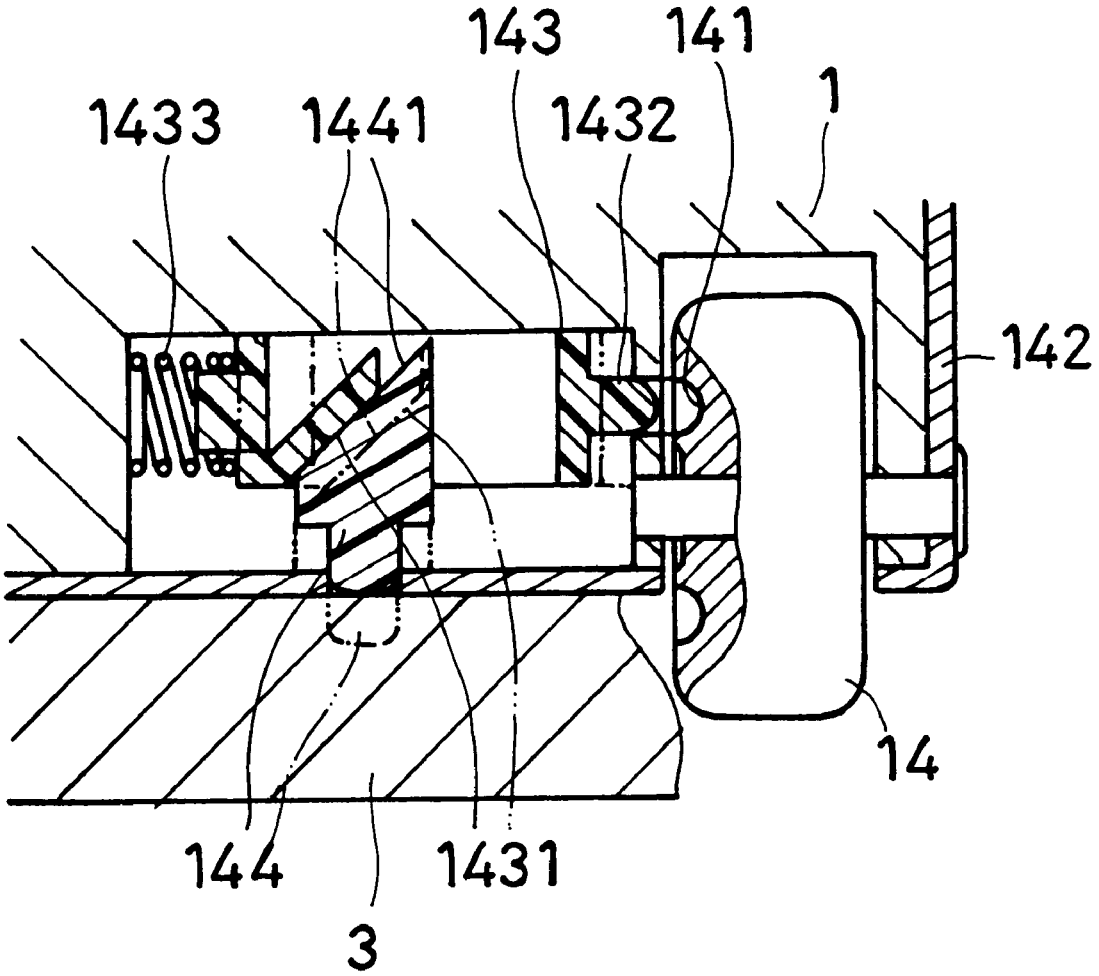
FIG. 10 is a cross sectional view of the wheel mechanism of the present invention.

Referring to FIGS. 1 and 10, a locating member 143 is mounted in the travel bag 1 near the wheel 14 of one wheel holder 142 of the travel bag 1, and supported on a spring 1433. The locating member 143 has a pin 1432. A knob 144 is mounted in the travel bag 1, having a bevel face 1441 disposed in contact with a bevel face 1431 on the locating member 143. When the table board 3 is extended out, the locating member 143 is forced outwards by the spring 1433, causing the pin 1432 of the locating member 143 to be forced into engagement with one locating hole 141 on the wheel 14 to stop the wheel 14 from rotation. When the table board 3 is closed on the travel bag 1, the knob 144 is forced inwards to move the locating member 143 backwards, thereby causing the pin 1441 to be moved backwards with the locating member 143 and disengaged from the wheel 14.

While only one embodiment of the present invention has been shown and described, it will be understood that various modifications and changes could be made thereunto without departing from the spirit and scope of the invention disclosed.

What the invention claimed is:

1. A combination of travel bag and folding table, comprising:

a travel bag having a top side, a bottom side, and a plurality of wheel holders respectively mounted on said bottom side, said wheel holders each holding a wheel;

a table board having a fixed end pivoted to the top side of said travel bag and a free end, the fixed end of said table board having a smoothly arched portion;

hinge means coupled between the top side of said travel bag and the fixed end of said table board, said hinge means comprising a first leaf fixedly fastened to said travel bag, a second leaf integral with the smoothly arched portion of the fixed end of said table board, said first leaf having a plurality of longitudinally aligned barrels and a longitudinal locating groove adjacent to the barrels on said first leaf, said second leaf having a plurality of longitudinally aligned barrels, and a pivot pin mounted in the barrels at said first leaf and the barrels at said second leaf to secure said first leaf and said second leaf together, for permitting said table board to be turned about said pivot pin relative to said travel bag within a limited angle, said first leaf having a longitudinal locating groove, said second leaf having a flange at one side inserted into the longitudinal locating groove on said first leaf to limit the turning angle of said table board about said pivot pin;

a retractable stand pivoted adjacent to the free end of said table board, said retractable stand comprising two coupling holder frames bilaterally pivoted to the fixed end of said table board at a bottom side by a respective pivot, said coupling holder frames each having a longitudinal sliding slot, two sleeves respectively pivoted to said coupling holder frames by a respective pivot, said sleeves each having a longitudinal sliding slot corresponding to the longitudinal sliding slots on said coupling holder frames, a control block connected between said sleeves at one end remote from said coupling holder frames, two inner tubes slidably inserted into said sleeves, a foot connected between said inner tubes at one end remote from said sleeves two side plates respectively coupled to said foot plate at two opposite sides and turned between a first position where said side plates are longitudinally aligned with said foot and a second position where said side plates are attached to a foot plate, two folding braces, said folding brace each having one end pivoted to one coupling holder frame and an opposite end pivoted to said table board, two push rods respectively coupled to said sleeves and moved along longitudinal sliding slots on said sleeves and said coupling holder frames, said push rods each having a hooked end extended out of the longitudinal sliding slots on said coupling holder frames and said sleeves and retained in contact with said folding braces, spring means respectively mounted in said coupling holder frames and imparting an outward pressure to said push rods respectively, said push rods being forced inwards to collapse said folding braces when said inner tubes are received in said sleeves, and two torsional springs respectively mounted on the pivots at said coupling holder frames, said torsional springs each having one end stopped at said table board and an opposite end connected to a lug at one coupling holder frame, said control block comprising two locating members, a spring connected between said locating members, said locating members each having a pin at an outer side respectively forced by the spring between said locating members into engagement with respective locating holes at said inner tubes to stop said inner tubes from axial movement in said sleeves, and a control knob coupled to said locating members, said locating members being pulled inwards to disengage the respective pins from the locating holes on said inner tubes when said control knob is depressed, for permitting said inner tubes to be moved in and out of said sleeves;

first lock means for securing said table board, said retractable stand and said travel bag together when said table board is collapsed and attached to said travel bag, said first lock means comprising a knob mounted on said table board, a box at said table board remote from said knob, a link having a top end coupled to the knob of said first lock means and a bottom end inserted into said box, a movable hook coupled to the bottom end of said link inside said box, spring means mounted inside said box and imparting an upward pressure to said movable hook, and a fixed hook fixedly mounted on said travel bag at one side, said fixed hook being inserted through a hole on said box into engagement with said movable hook to secure said table board in place when said table board is closed on said travel bag, said movable hook being disengaged from said fixed hook when the knob of said first lock means is depressed, said link having a hook, the hook of said link being forced into engagement with the foot of said retractable stand when said retractable stand is collapsed and attached to said table board; and second lock means for stopping the wheels of said travel bag from moving.

2. The combination of travel bag and folding table of claim 1, wherein said second lock means comprises a latch mounted in said travel bag near the wheel of one wheel holder of said travel bag, spring means which imparts an outward pressure to said latch, causing said latch to be forced into engagement with one of a series of locating holes on the wheel of the adjacent wheel holder, and a knob mounted on said travel bag and controlled to disengage said latch from the locating holes on the corresponding wheel.

* * * * *